United States Patent [19]

Quinlan et al.

[11] 4,161,434

[45] Jul. 17, 1979

[54] METHOD FOR SEPARATING TRIALUMINUM NICKELIDE FIBERS FROM AN ALUMINUM MATRIX

[75] Inventors: Kenneth P. Quinlan, Newton; Joseph J. Hutta, Groton, both of Mass.

[73] Assignee: The United States of America as represented by the Secretary of the Air Force, Washington, D.C.

[21] Appl. No.: 950,658

[22] Filed: Oct. 12, 1978

[51] Int. Cl.[2] ..... C25F 5/00; C25F 3/00; C25F 3/04

[52] U.S. Cl. ..... 204/146; 204/129.8

[58] Field of Search ..... 204/146, 129.75, 140, 204/141.5, 129.8

[56] References Cited

U.S. PATENT DOCUMENTS

| | | | |
|---|---|---|---|
| 3,002,908 | 10/1961 | Hall | 204/146 |
| 3,254,011 | 5/1966 | Zaremski | 204/129.8 |
| 3,615,900 | 10/1971 | Lee | 204/146 |
| 4,100,044 | 7/1978 | Hussey et al. | 204/146 |

OTHER PUBLICATIONS

Transactions of the Metallurgical Society of Aime, vol. 239, Jun. 1967, p. 845.

Transactions of the Metallurgical Society of Aime, vol. 233, Feb. 1965, p. 335.

*Primary Examiner*—T. M. Tufariello

*Attorney, Agent, or Firm*—Joseph E. Rusz; William J. O'Brien

[57] ABSTRACT

Electrolytic production of $Al_3Ni$ fibers using a potassium hydroxide electrolyte.

3 Claims, 3 Drawing Figures

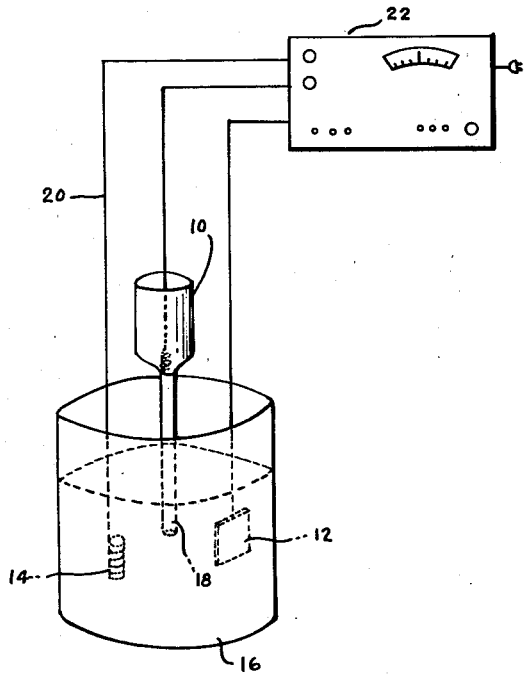

METHOD FOR SEPARATING TRIALUMINUM NICKELIDE FIBERS FROM AN ALUMINUM MATRIX

STATEMENT OF GOVERNMENT INTEREST

The invention described herein may be manufactured and used by or for the Government for governmental purposes within the payment of any royalty thereon.

BACKGROUND OF THE INVENTION

This invention relates to a method for separating trialuminum nickelide fibers from an aluminum matrix. More particularly, this invention concerns itself with the electrolytic production of trialuminum nickelide fibers from an aluminum/trialuminum nickelide two phase composite matrix.

Considerable interest has been developed in the utilization of aluminum nickel fibers. These fibers find application for use as catalysts, obfuscating agents, and as components for microelectronics. Their wide application results from the fact that inclusion of a controlled eutectic alloy of trialuminum nickelide within an aluminum body provides an effective means for giving high tensile strength enhancement to the aluminum body. The alloy is grown within the aluminum body as an aligned microstructure in the form of whiskers by a technique referred to as unidirectional solidification. In addition to providing improved tensile strength, the whiskers of trialuminum nickelide are useful, in and of themselves, in a variety of industrial and military microelectronic applications provided they can be removed undamaged from the aluminum matrix in which they are embedded.

A number of methods are utilized for producing trialuminum nickelide whiskers in aluminum matrix. One such method uses a unidirectional solidification technique. Another method involves the growth of aluminum nickel fiber bundles longitudinally in a rod shaped matrix. Still other methods are contemplated and a considerable research effort is being conducted in an attempt to develop even more efficient means of growing these useful fibers. However, a fundamental problem exists in the removal and separation of the fibers from the aluminum/trialuminum-nickelide two phase matrix within which they are grown. Therefore, a need exists for the development of an efficient and practical removal method in order to study the effectiveness of prior art growth procedures as well as those conceived in the future. Also, the usefulness of the individual fibers themselves for microelectronic applications is severely limited unless an efficient means can be developed for their removal from the aluminum matrix without encountering severe damage during the removal procedure.

In previous methods, aqueous electrolytes or acid etches were utilized for removing or dissolving the aluminum from the aluminum/aluminum-nickelide matrix. Unfortunately, these methods have always been accompanied by gas evolution resulting in "birdnesting" of the fiber bundles as they are exposed. Still another problem encountered in using aqueous acid etches was their low selectivity of attack. For example, the aluminum nickelide fibers were dissolved as well as the bulk aluminum. It became obvious, therefore, that an electrolyte that could sustain aluminum electrolysis without gas evolution while simultaneously committing selective attack on the bulk aluminum phase of the aluminum containing matrix would circumvent the problems encountered in using prior art methods of separation.

In attempting to overcome the problems encountered with prior art methods of separating aluminum from a two-phase matrix of aluminum and trialuminum nickelide filaments, a method was developed using an electrolytic procedure for etching away the trialuminum nickelide fibers previouly formed in the aluminum matrix. In the electrolytic etching procedure referred to, two molten salts containing aluminum chloride were utilized. This method proved quite successful; but, required an inert atmosphere and high temperature conditions as processing parameters. The high temperature conditions and inert atmospheric conditions required for use with this method posed serious processing problems and increased the overall cost of the unit operation.

With the present invention, however, it has been discovered that the problems encountered in prior art methods, as well as in prior art electrolytic procedures utilizing high temperture and inert atmospheric conditions could be overcome by a method which utilizes potassium hydroxide as the electrolyte. The method is carried out within a time period during which the aluminum nickelide fibers are not attacked by the potassium hydroxide. The process is inexpensive and is carried out under ambient conditions. It produces high quality fibers which cannot be duplicated by other methods.

SUMMARY OF THE INVENTION

In accordance with this invention, an electrolytic separation procedure has been found for the selective separation of trialuminum nickelide fibers from an aluminum containing two-phase composite matrix. The matrix contains aluminum and an aligned microstructure of a trialuminum nickelide alloy in fiber form. The procedure of this invention provides a method for separating the trialuminum nickelide fibers in extremely good condition while using inexpensive chemicals and ambient processing conditions. The process consists of dissolving the aluminum matrix electrochemically. The electrochemical oxidation of the aluminum matrix is performed in a one molar solution of potassium hydroxide with the aluminum being oxidized to the soluble trivalent aluminum ($H_2ALO_3$—).

Accordingly, the primary object of this invention is to provide an efficient means for bringing about the removal of aluminum from a two-phase composite matrix consisting of aluminum and trialuminum nickelide filaments.

Another object of this invention is to provide an electrolytic procedure that selectively removes unwanted aluminum from a two-phase composite matrix containing aluminum and trialuminum nickelide whereby trialuminum nickelide filaments within the matrix are left unaffected.

Still another object of this invention is to provide an electrolytic process for removing aluminum from a two-phase composite aluminum/aluminum nickelide matrix that does not produce unacceptable gaseous byproducts.

A further object of this invention is to provide an electrolytic process for producing trialuminum nickelide filaments that is simple, efficient and economical, utilizes conventional equipment, readily available materials, and is performed under ambient processing conditions.

The above and still further objects and advantages of the present invention will become more readily apparent upon consideration of the following detailed description thereof when taken in conjunction with the accompanying drawings.

DESCRIPTION OF THE PREFERRED EMBODIMENT

With the above mentioned and other objects in mind, the present invention contemplates a novel and improved electrolytic process for removing aluminum from a two-phase composite matrix consisting of aluminum and trialuminum nickelide filaments. A one molar potassium hydroxide solution is used as the novel electrolyte for the method of this invention. The electrolysis is carried out within a time period wherein the aluminum nickelide fibers are not attacked by the potassium hydroxide electrolyte. The advantages of using a potassiumum hydroxide electrolyte over prior art methods which use acid etches or molten salts containing aluminum chloride are obvious.

The controlled potential electrolysis of this invention was accomplished with a potentiostat/galvanostate (Princeton Applied Research Corporation, Model 173) equipped with a current to voltage converter (PAR, Model 176). A universal programmer (PAR, Model 175) controlled the voltage output of the potentiostat. The process was carried out in a conventional electrolytic cell, such as that shown in FIG. 1.

Figure 1:
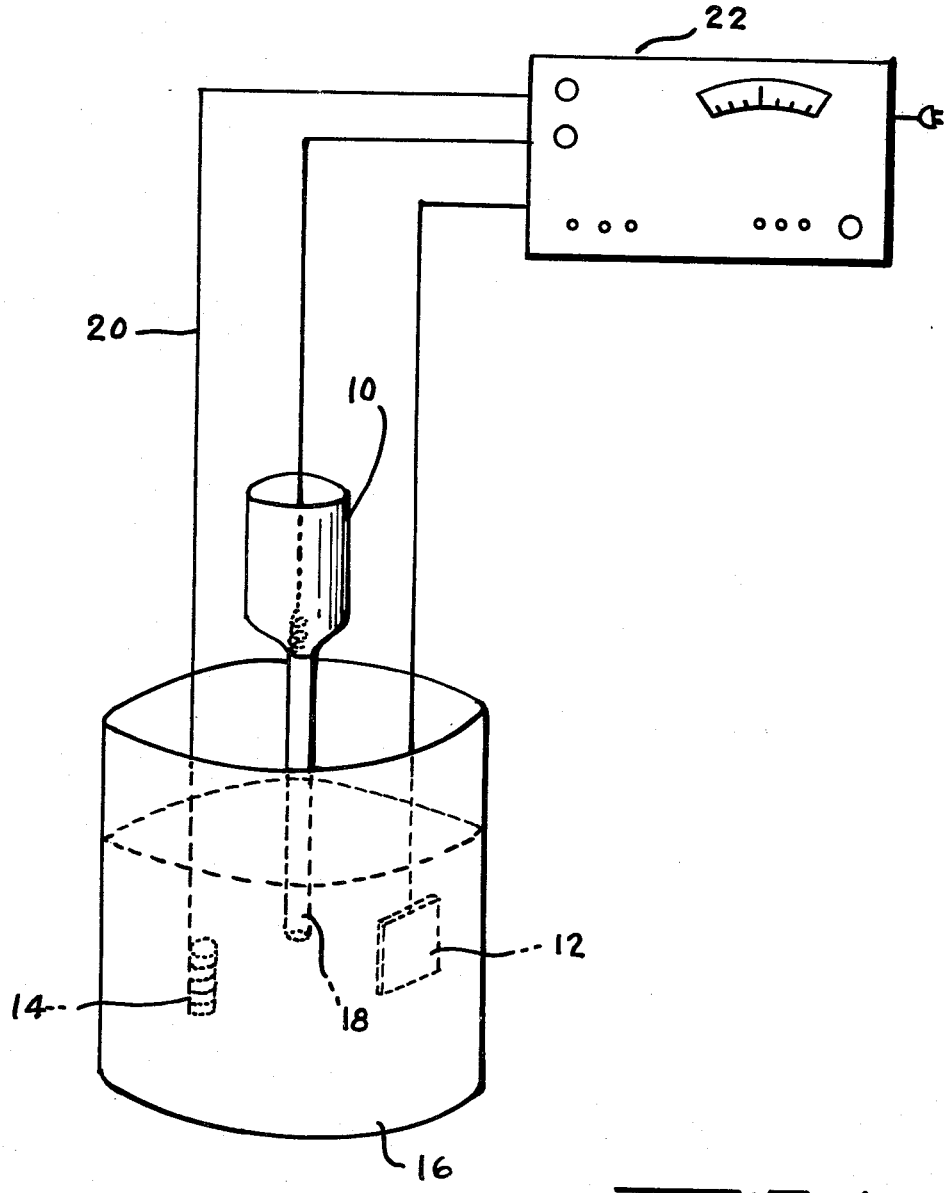
FIG. 1 represents a schematic illustration showing an electrolytic cell used in carrying out the method of this invention.
Figure 2:
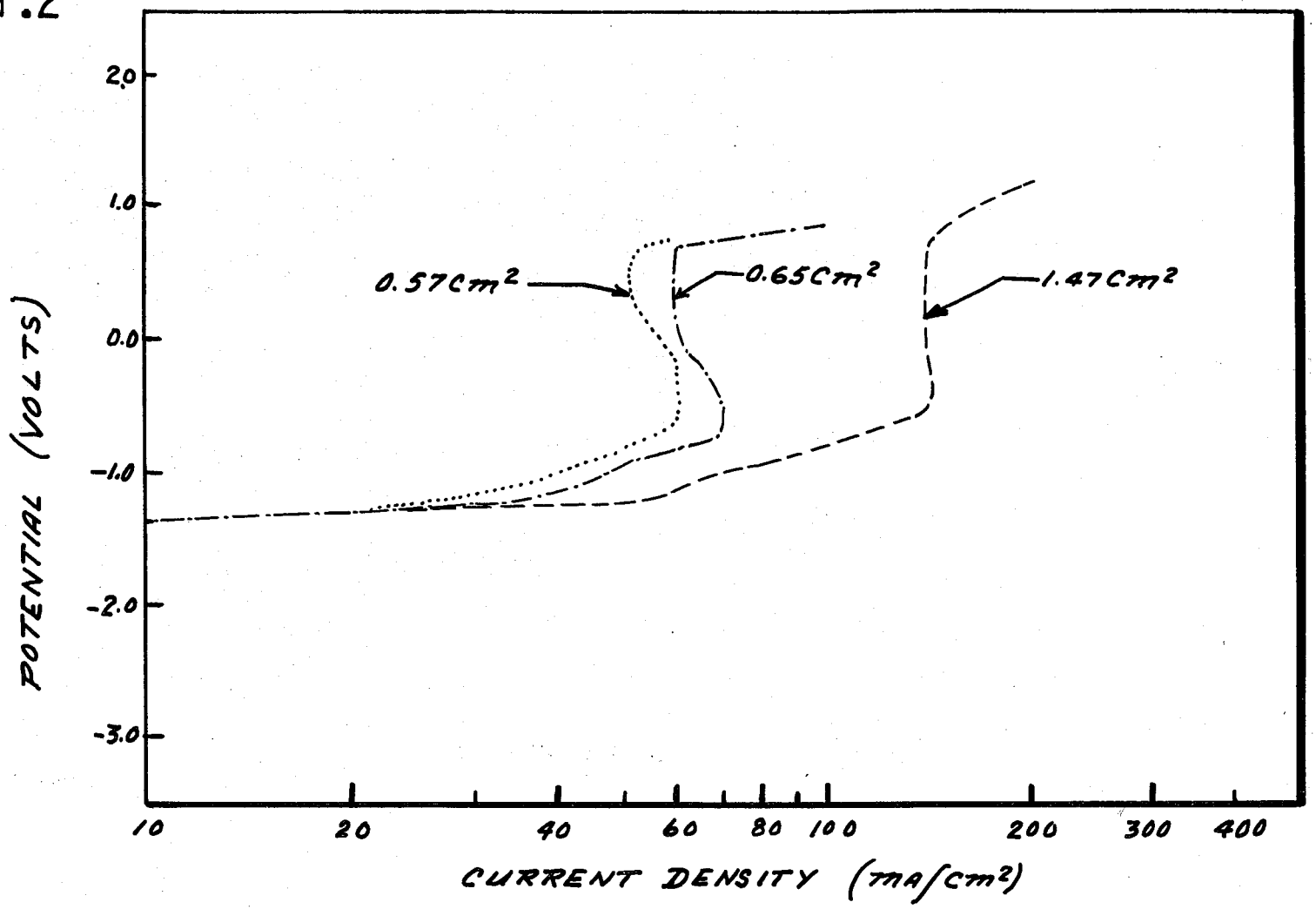
FIG. 2 represents a graphical illustration showing the anodic polarization of aluminum nickelide/aluminum eutectic samples.

The cell as shown in FIG. 1 consists of a reference saturated calomel electrode 10. A platinum counter electrode 12 and an aluminum/aluminum nickelide alloy ingot has a working electrode 14. The electrolyte 16 was a one molar potassium hydroxide solution. An agar-saturated potassium chloride salt bridge 18 was used with the calomel electrode 10. Contact to the aluminum/aluminum nickelide ingot was made by wrapping platinum wire 20 around the ingot 10 which, in turn, was connected to one side of a potentiostat 22. Electrolysis was carried out for one and one half hours at a potential of −0.2 volts in unstirred solution. As shown in FIG. 2, maximum anodic current was observed at −0.2 volts in the anodic polarization curve of the aluminum-aluminum/nickelide electrode. The anodic polarization curve also demonstrated that the values of the potential for electrolysis of the aluminum matrix can vary from −1.2 to +0.5 volts. The current density decreased from an initial value of 0.02A/cm$^2$ to 0.01 A/cm$^2$ during the electrolysis. The ingot turned black and was composed of a matted mass of aluminum nickelide fibers. Scanning electron micrographs of the product illustrated the preferential etching of the aluminum leaving well defined fibers. Energy dispersive x-ray analysis verified their composition of aluminum and trialuminum nickelide.

Figure 3:
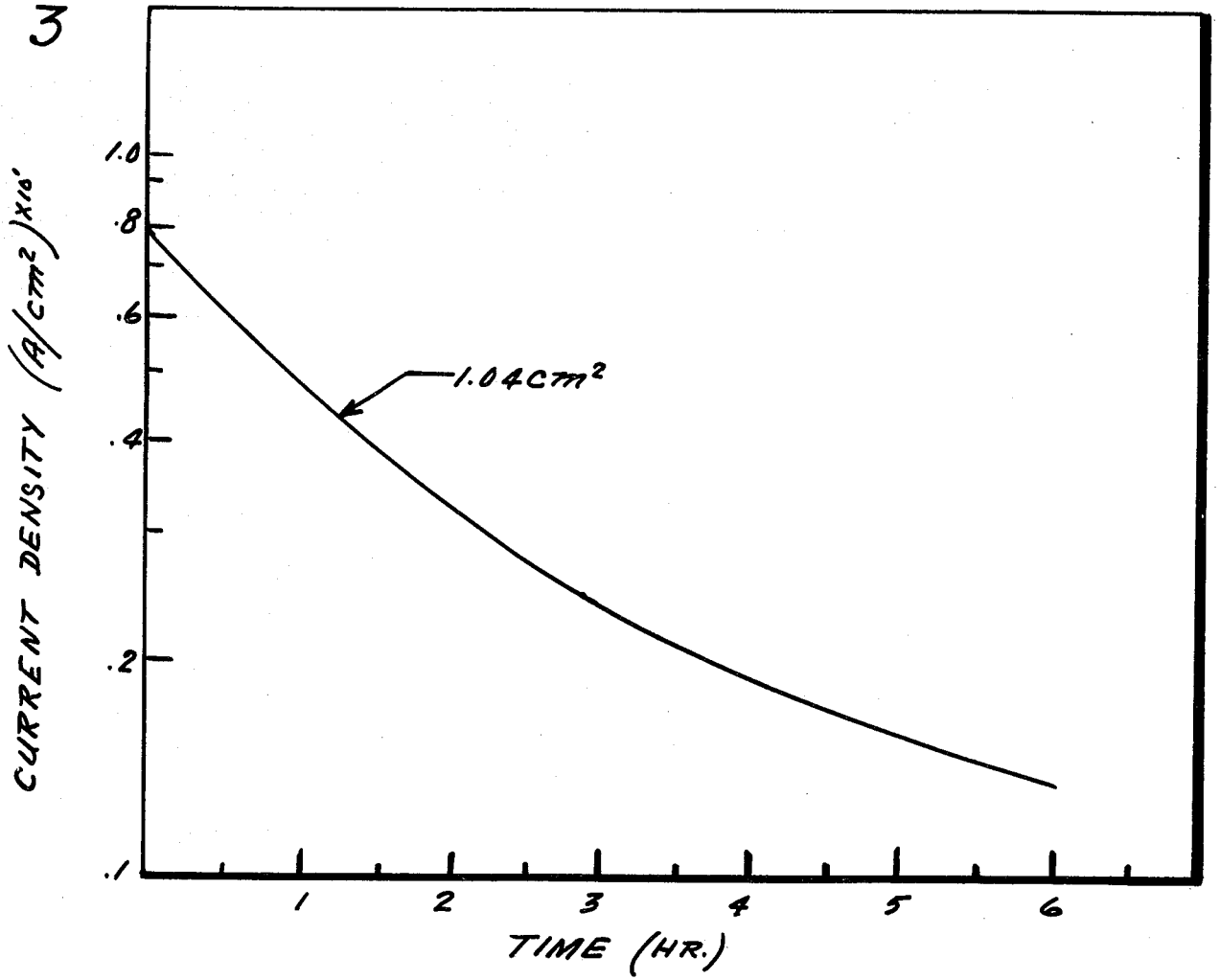
FIG. 3 represents a graphical illustration showing the variation of current density with time for the electrolytic removal of the aluminum matrix from the aluminum nickelide eutectic alloy.

FIG. 3 discloses the variation of current density against time for the electrolytic removal of the aluminum from the aluminum/trialuminum nickelide alloy. A constant potential of 0.03 volts was utilized with a sample area of 1.04 cm$^2$. In FIG. 2 sample sizes were respectively 0.57 cm$^2$, 0.65 c,hu 2, and 1.47 cm$^2$ as be shown by referring to FIG. 2.

The present invention solves the problems which necessitates the use of extreme conditions to separate aluminum nickelide fibers from an aluminum-containing two-phase matrix. The use of high temperature conditions, organic solutions and inert atmospheres all pose serious problems and increased expense. These problems are overcome by the present invention. Also, the present invention has the additional advantage of being applicable to a continuous process wherein the fibers can be removed and the potassium hydroxide replenished in a continuous manner.

While the invention has been described with particularity in reference to a specific embodiment thereof, it should be understood that the disclosure of the present invention is presented for the purpose of illustration only, and is not intended to limit the invention in any way. The scope of which is defined by the appended claims.

What is claimed is:

1. An electrolytic process for separating aluminum nickelide fibers from a solid, two-phased, composite matrix of aluminum and trialuminum nickelide filaments which comprises the steps of passing an electric current between (A) a cathode composed of an inert material; and (B) an anode composed of a two-phased composite matrix of aluminum and trialuminum nickelide filaments; while (C) both anode and cathode are immersed in a one molar solution of potassium hydroxide to effectively remove said aluminum nickelide filaments from said matrix without adversely effecting said nickelide filaments.

2. A process in accordance with claim 1 wherein said electrolytic process is performed at a controlled potential ranging from −1.0 to +0.5 volts for a period of approximately one and a half hours.

3. A process in accordance with claim 2 wherein said electrolytic process is performed at a controlled potential of about −0.2 volts.

* * * * *